United States Patent [19]

Ammann

[11] Patent Number: 4,546,731

[45] Date of Patent: Oct. 15, 1985

[54] HEAT EXCHANGER HAVING A GAS FLUE

[75] Inventor: Heinz Ammann, Winterthur, Switzerland

[73] Assignee: Sulzer Brothers Limited, Winterthur, Switzerland

[21] Appl. No.: 643,449

[22] Filed: Aug. 23, 1984

[30] Foreign Application Priority Data

Aug. 31, 1983 [CH] Switzerland ..... 4774/83

[51] Int. Cl.[4] ..... F22B 37/00

[52] U.S. Cl. ..... 122/367 R; 122/6 A; 122/235 A; 122/235 K

[58] Field of Search ..... 122/367 R, 367 C, 6 A, 122/235 A, 235 D, 235 K, 512; 165/76, 169

[56] References Cited

U.S. PATENT DOCUMENTS

| | | | |
|---|---|---|---|
| 3,299,858 | 1/1967 | Franzmann | 122/6 A |
| 3,809,016 | 5/1974 | Kral et al. | 122/235 A |
| 3,814,062 | 6/1974 | Vollhardt | 122/6 A |
| 4,355,602 | 10/1982 | Cooke | 122/6 A |
| 4,394,849 | 7/1983 | Pratt et al. | 122/235 K |
| 4,395,268 | 7/1983 | Zabelka | 122/235 A |
| 4,418,652 | 12/1983 | Rees | 122/235 A |

FOREIGN PATENT DOCUMENTS

| | | | |
|---|---|---|---|
| 1104108 | 4/1961 | Fed. Rep. of Germany | 122/235 D |

*Primary Examiner*—Henry C. Yuen
*Attorney, Agent, or Firm*—Kenyon & Kenyon

[57] ABSTRACT

The heat exchanger has a cover which is formed by parallel groups of terminal tubes which connect with at least 80% of the wall tubes of the flue. In one embodiment, the terminal tubes of adjacent groups meet in a common zone and extend upwardly into a common header. In another embodiment, the terminal tubes of alternating groups are disposed in different layers with one layer covering over open triangular areas defined between adjacent tube groups of the other layer.

9 Claims, 8 Drawing Figures

HEAT EXCHANGER HAVING A GAS FLUE

This invention relates to a heat exchanger having a gas flue.

As is known, various types of heat exchangers, for example, for use as steam or vapor generators, have been known. In many cases, the heat exchanger consists of medium-carrying wall tubes which extend substantially parallel to a longitudinal axis to define a gas flue with the tubes, welded together so as to be gas-tight. In addition, the gas flue has been terminated at at least one end by medium-carrying tubes which are also welded together so as to be gas tight and which extend transversely of the longitudinal axis of the gas flue.

A heat exchanger of the above type has been known wherein the gas flue has a rectangular cross-section. In order to terminate the top end of this gas flue, the tubes of two opposite side walls of the flue are bent inwards through ninety degrees at their top end and run as far as the center of the flue. These wall tubes are then bent upwards where the two bent side walls meet and run directly to straight headers which are disposed in parallel to the top end of the flue and perpendicularly to the tubes. This construction is relatively simple although the construction has a number of basic disadvantages.

First, the bent tubes of the side walls are longer than the tubes in the other two side walls. The medium flowing through the bent tubes is thus subjected to hot flue gas in the gas flue for a longer period of time than the medium flowing through the other unbent wall tubes. The medium thus emerges from the four walls of the gas flue into thermodynamically different conditions.

Second, the known construction can be applied only to gas flues of rectangular cross-section. That is, the construction cannot be used if the gas flue has a cross-section of more than four sides or a cylindrical cross-section.

It has also been known to completely separate the side walls of a gas flue from the tubing of the gas flue end by connecting the two sets of tubing to their own headers which are not interconnected. However, this construction has not been particularly used in practice generally because the size of the gas flues in question result in different thermal expansion between the gas flue tubing and the gas flue end tubing. This, in turn, leads to problems which require very complex and expensive means for solution.

Accordingly, it is an object of the invention to provide a heat exchanger of relatively simple construction which can be terminated at least at one end in a simple manner.

It is another object of the invention to provide a heat exchanger construction which can be used for any cross-sectional shape of a gas flue.

It is another object of the invention to provide a relatively simple construction of a heat exchanger wherein a working medium passes through the walls and cover of a gas flue over substantially equal lengths of tubing therein.

Briefly, the invention provides a heat exchanger which is comprised of a plurality of medium-carrying wall tubes which extend parallel to a longitudinal axis in order to define a gas flue and a plurality of medium-carrying terminal tubes which extend transversely to the longitudinal axis at at least one end of the flue. In accordance with the invention, these terminal tubes are connected to at least eighty per cent of the wall tubes to convey a medium therebetween.

The wall tubes are further connected together in gas-tight relation while the terminal tubes are also connected together in gas-tight relation.

The construction in which at least eighty per cent of the medium flowing through the wall tubes is feed to all the tubes of the terminal tubes gives a surprisingly simple construction for practically any cross-sectional shape of the gas flue. Further, any differences in tube lengths in this construction are much less than in the known heat exchangers.

Apart from the simplicity of construction, the previously known techniques for constructing heat exchangers can be applied immediately for manufacture and assembly of the heat exchanger. Further, good accessibility to the tubing of the terminal end of the gas flue can be obtained, particularly for maintenance work.

In one embodiment, the wall tubes extend parallel in a common plane to the terminal tubes while the terminal tubes extend in groups to meet each adjacent group along a common zone. Further, in this emdodiment, the terminal tubes are bent parallel to the longitudinal axis of the gas flue and extend to respective headers which are located in parallel to a respective zone.

In a further embodiment, the terminal tubes may extend in two layers with alternating groups of terminal tubes being disposed in a common plane and being interconnected to respective headers.

These and other objects and advantages of the invention will become more apparent from the following detailed description taken in conjunction with the accompanying drawings wherein.

Figure 1:
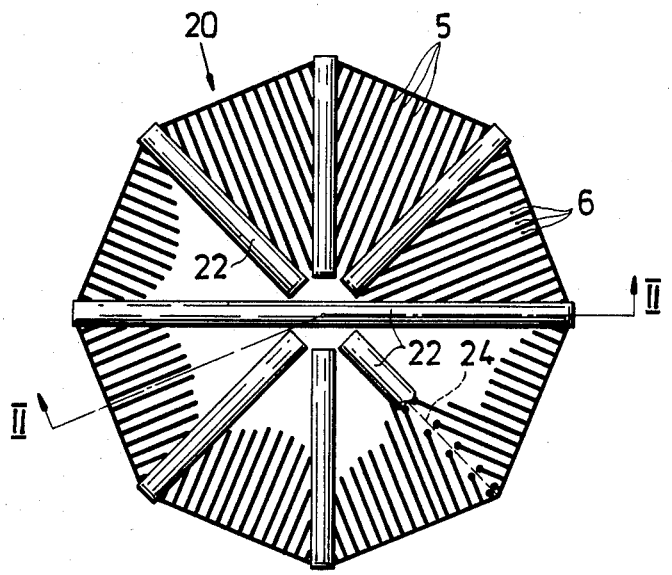
FIG. 1 illustrates a diagramatic plan view of one end of a gas flue constructed in accordance with the invention.
Figure 2:
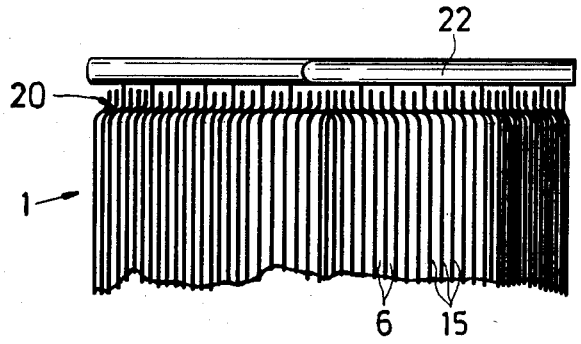
FIG. 2 illustrates a veiw taken on line II—II of FIG. 1.

Referring to FIGS. 1 and 2, the heat exchanger has a vertical gas flue 1 which is formed by a plurality of medium-carrying wall tubes 15 extended parallel to a longitudinal axis of the flue as well as a cover which is defined by a plurality of medium-carrying terminal tubes 5 which extend transversely to the flue axis at the end of the flue. As indicated in FIG. 1, the gas flue 1 has the shape of a straight prism of octagonal cross section. Further, the tubes 15 of each of the eight sides of the flue 1 are welded together in gas-tight relation via webs 6. In like manner the tubes 15 are connected together in gas-tight relation via webs 6.

As shown FIG. 2, the tubes 15 of the sides of the gas flue 1 are bent inwardly through 90 degrees and merge into the substantially horizontally extending tubes 5. The terminal tubes, in turn, extend in parallel relationship to each other and extend in groups to meet each adjacent group along a common zone. As indicated FIG. 1, each group of terminal tubes 5 extend toward the center of the gas flue 1 from each side. In each case, the parallel run of tubes 5 define a triangular area with the outer most tube in each group meeting the outer most tube of the adjacent group in a common zone 24.

As shown FIG. 2, the terminal tubes 5 are bent upwardly parallel to the longitudinal axis of the flue in the zones 24 to extend to respective headers 22. As indicated, each header 22 is disposed in parallel to a zone 24 and horizontally above the gas flue 1. Together with the web 6, all the tubes 5 situated in the eight triangular areas form a gas-tight cover 20 for the gas flue 1.

As indicated in FIG. 1, two headers 22 which are aligned with one another are combined to form a single header extending over the entire width of the gas flue 1.

As described, all of the wall tubes 15 of the gas flue 1 are continued into the cover 20. Hence, all the cover tubes are connected in series with one hundred per cent of the wall tubes of the gas flue on the medium side. The diferences in the tube lengths on each side of the flue with the associated triangular area are practically identical. Hence, the heat absorption of the medium flowing in the tubes becomes more uniform, as considered over the entire gas flue. Hence, the conditions of the medium upon entering the headers 22 are more uniform. After leaving the headers, in which the medium conditions are equalized by the mixing of the medium currents, the working medium is combined although the manner in which this accomplished is not shown. Thereafter, the working medium is either feed to other heating surfaces of the vapor generator or directly to a consumer.

As indicated FIGS. 1 and 2, the wall tubes 15 and the cover tubes 5 are disposed on an equal pitch.

Figure 3:
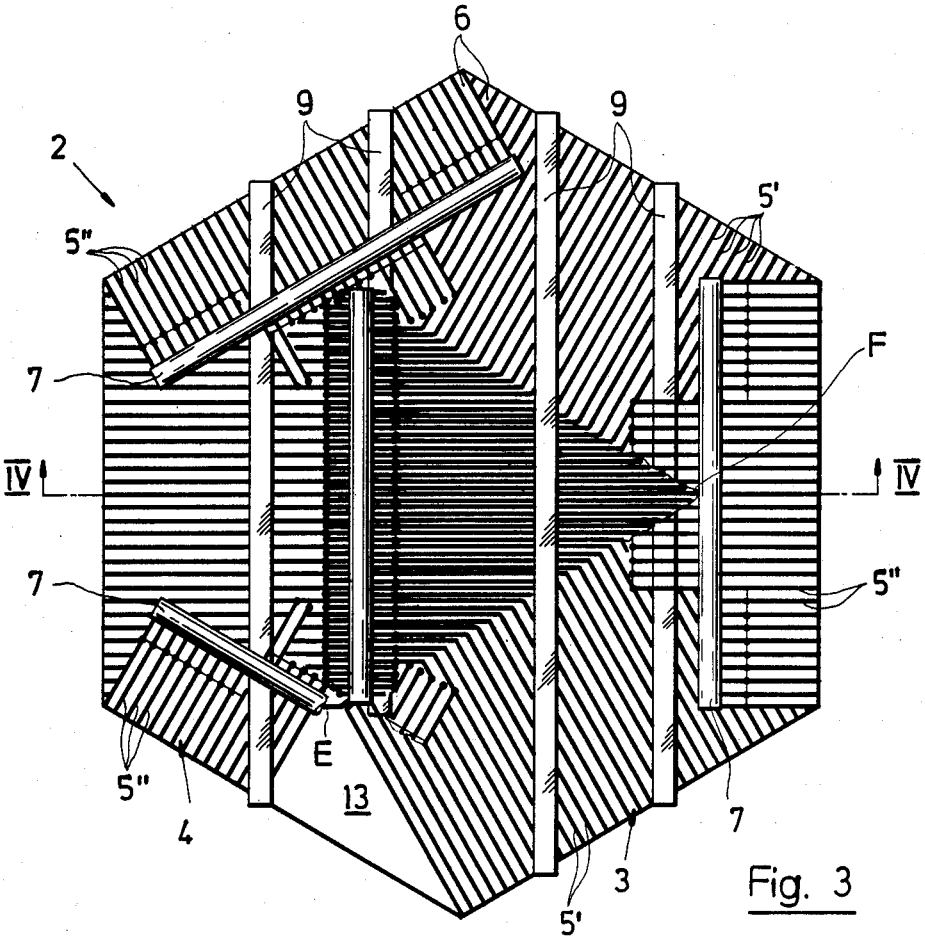
FIG. 3 illustrates a diagramatic plan view of a terminal end of a modified heat exchanger constructed in accordance with the invention.
Figure 4:
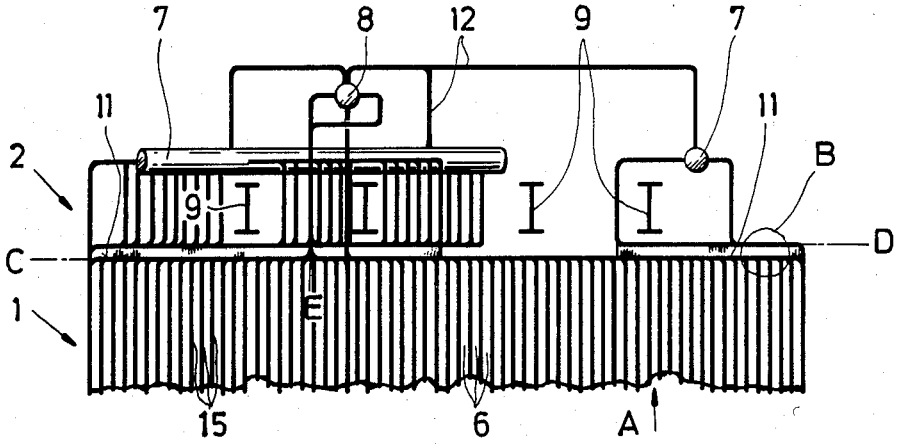
FIG. 4 illustrates a veiw taken on line IV—IV of FIG. 3.

Referring to FIGS. 3 and 4, wherein like reference characters indicate like parts as above, the vertical gas flue 1 may serve as a vapor generator combustion chamber. As shown, the gas flue 1 is in the form of a hexagonal prism with six equal sides. Each side is formed of vertical wall tubes which extend longitudinally of the flue land which are welded together in gas-tight manner by webs 6.

Referring to FIG. 4, the wall tubes 15 of three non-adjacent sides, i.e. the alternating sides of the prism, are bent inwardly through about 90 degrees into a first horizontal plane C at the end of the flue. As indicated in FIG. 3, these wall tubes merge into terminal tubes 5'. These terminal tubes 5', in turn, extend in groups in parallel relation to define a triangular opening between each pair of adjacent groups.

The tubes of the remaining sides of the flue are bent inwardly into a second horizontal plane D while extending in groups in parallel relation to cover each triangular opening in the first horizontal plane C. Thus, the tubes in the two spaced apart horizontal planes C, D, form two layers 3, 4 to define a cover 2 for the flue 1. As above, both layers 3, 4 are provided webs 6 welded in between the tubes 5', 5''.

Referring to FIG. 3, the tubes 5' of the first layer 3 which originate from the outer left wall of the gas flue 1, as viewed, extend with the associated webs 6 to a common line which extends between two points coincident with points where the outer most tube of one group meets an outer most tube of an adjacent group, one of these points being designated E. At this common line, the tubes 5' are bent upwardly and lead, after another bend through 90 degrees, horizontally into an end header 8. The tubes 5' of the layer 3 extending from the other two sides initially extend in similar manner to a common line, again extending from each of the two points E to a point F coincident with a point where the outer most tube of a respective group meets an outer most tube of an adjacent group. These tubes are then bent towards the connecting line between the first tube group. As shown in FIG. 3, the three grops of tubes extend to connecting lines which define a triangular shaped area so that extensions of the tubes 5' fill this area. As indicated the pitch of the tubes 5' is smaller within this triangular area than outside the area while the webs 6 are correspondingly narrower.

At the line connecting the points E at which all the tubes 5' of the first layer 3 meet, the tubes 5' having no webs 6 and a smaller pitch are bent upwardly and are taken to the end header 8 as indicated in FIG. 4.

Referring to FIG. 3, the first layer 3 of the cover 2 thus contains three triangular openings 13 only one of which is partially shown. These openings are covered by the tubes 5'' forming the second layer 4. Approximately half of the tubes 5'' coming from one side of the gas flue, in each case, form a middle strip which is extended towards the center of the gas flue to such an extent as to surmount the points E, F nearest thereto in the triangular areas of the first layer 3. At this end of each metal strip, the tubes 5'' are bent vertically upwards and, after another bend, run horizontally to a header 7 as indicated in FIG. 4. On either side of each metal strip, the other tubes 5'' coming from the associated gas flue side are run about half the distance of the tubes of the middle strip and are then bent vertically upwards and finally, after another bend, are bent over horizontally and connected to that intermediate header 7 to which the tubes of the metal strip also lead.

The webs 6 of the second layer 4 extend between the tubes 5'' only in the horizontal plane D. The intermediate headers 7 are also connected to the end header 8 by connecting tubes 12 as indicated in FIG. 4. As the end header 8, the intermediate header 7 are disposed substantially horizontally, the intermediate header 7 and the end header 8 being situated at right angles to the tubes 5'' and 5' leading into each. The connecting tubes 12 and those portions of the tubes 5', 5'' which extend outside the first layer 3 and outside the second layer 4 are of a length and configuration so as to have the required flexibility to readily take deformation due to different thermal expansion in the cover 2 or due to earthquakes.

As shown in FIGS. 3 and 4, four horizontal members 9 are distributed in pairs symetrically with respect to the longitudinal axis of the gas flue 1. These members 9 are disposed at a height between the second layer 4 and the intermediate headers 7, that is between the two groups in the respective planes C, D.

The horizontal members 9 are connected in known manner to the cover 2 by a rigid connection at the center and by a plurality of connections distributed over their length to slide in the longitudinal direction relative to the tube groups. In addition, the members 9 are pivotally connected at each end to a side of the gas flue in order to transmit stresses from the tube groups to the flue sides. Any suitable joints may be used to form the pivotal connection between the members 9 and the gas flue sides.

The flexural stresses of the cover 2 can be transmitted to the walls as a purely tensile or compressive stress, the sliding connections and joints taking thermal expansions in the longitudinal direction of the members 9.

The tubes 5'' which extend around the members 9 are at a distance so as to carry out their function in an undisturbed manner.

Figure 5:
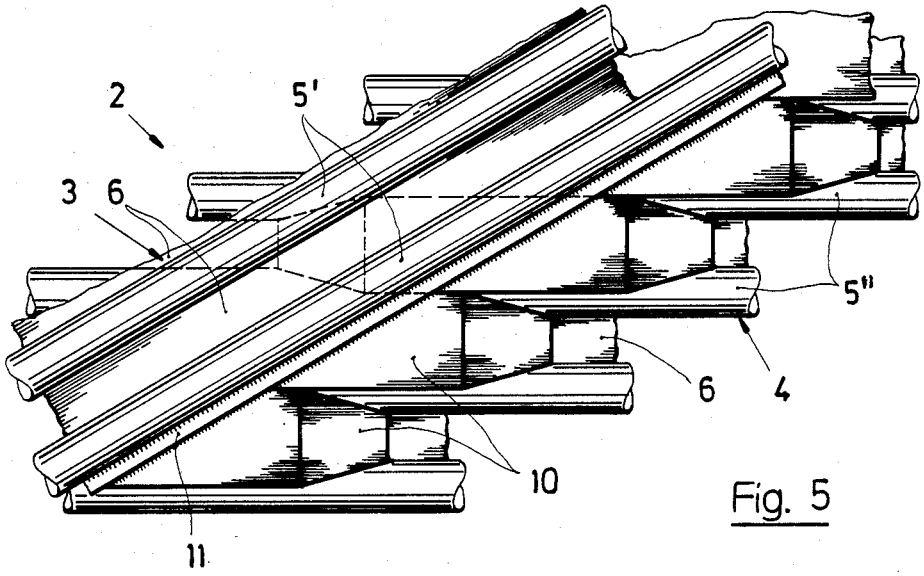
FIG. 5 illustrates an enlarged detail taken in the direction of arrow A of FIG. 4.
Figure 6:
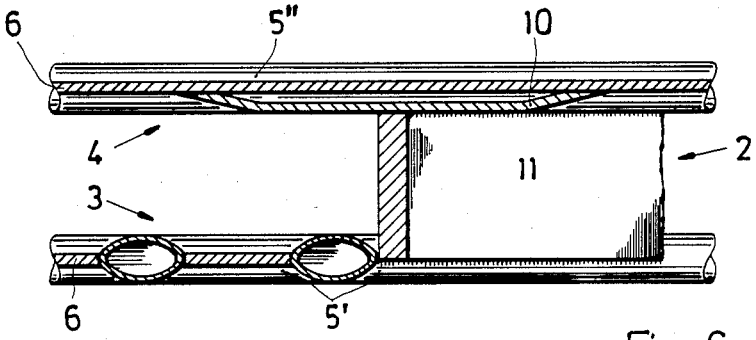
FIG. 6 illustrates an enlarged detail taken in the area B of FIG. 4.

Referring to FIGS. 5 and 6, cover plates 10 are welded to the underside of the second layer 4 parallel to each edge of the triangular openings 13. In addition, each such plate 10 so connects two adjacent tubes 5'' that adjacent cover plates 10 contact one another and all the plates 10 together form plane surfaces. In addition, sheet metal strips 11 connect the first layer 3 to the second layer 4 along the edges of the triangular openings 13 so that the interior of the gas flue 1 is sealed off from the surroundings. These sheet metal strips 11 are welded in seal-tight relationship to the plane surfaces of the cover plates 10 approximately level with the longitudinal axis of the tubes 5' as well as to the tubes 5' (see FIG. 6). The welds are thus readily accesible from below both during manufacture and subsequently for any inspection. In order to ensure the seal between the interior of a gas flue 1 and the surroundings, the two ends of the cover plates 10 are extended as far as the webs 6 between the tubes 5'' and are welded thereto in seal-tight relationship.

Figure 7:
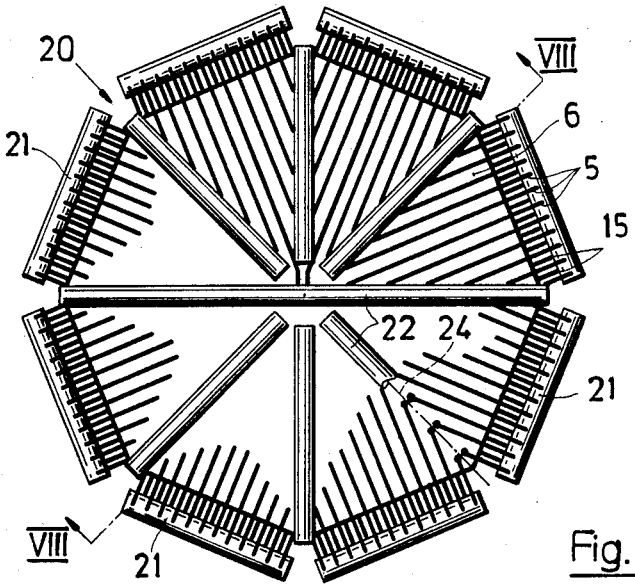
FIG. 7 illustrates a diagramatic plan view of a further embodiment of a heat exchanger constructed in accordance with the invention.
Figure 8:
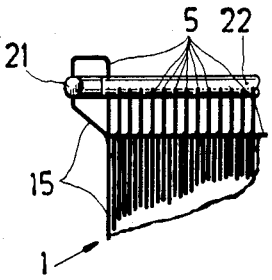
FIG. 8 illustrates a view taken on line VIII—VIII of FIG. 7.

Referring to FIGS. 7 and 8, wherein like reference characters indicate like parts as above, the gas flue may be of regular octagonal cross-section. In this case, the wall tubes 15 of the gas flue are bent outwards near the top end and run to intermediate headers 21. A header 21 of this kind is provided parallel to each side of the gas flue 1. The tubes 5 leaving each intermediate header 21 extend in parallel relationship and enter the gas flue 1 in each case between two walls tubes 15 to form the cover 20. They also extend in parallel relationship in the cover 20 as far as the edge zone 24, where they meet tubes 5 from the adjacent intermediate header 21.

As in the exemplified embodiment in FIGS. 1 and 2, the tubes 5 are bent upwards out of the cover 20 at the edge zones 24 and run to headers 22 which extend along the zones 24. The length of the tube portions projecting upwardly out of the cover 20 is such that they have sufficient flexibility readily to take any deformation due to thermal expansion or earthquakes.

The intermediate headers 21 can be disposed in the flow of medium in a different way from that shown in FIG. 7. For example, the wall tubes 15 of a wall of the gas flue 1 may be connected via the associated intermediate header to tubes 5 which do not lie in that triangular portion of the cover 20 which adjoins the said wall.

Advantageously, in all the exemplified embodiments, in order to prevent corrosion and/or starting-up problems, the tubes in the cover are advantageously disposed at some inclination to the horizontal so that liquid medium and residues contained therein can flow away in the tubes.

Of course access means, such as manholes, may be provided in known manner in the cover.

The invention thus provides a heat exchanger which can be terminated in a relatively simple manner. Further, the technique for closing off the end of a gas flue can be used for flues of any polygomal cross-section as well as for flues of circular shape.

What is claimed is:

1. A heat exchanger comprising a plurality of medium-carrying wall tubes extending parallel to a longitudinal axis to define a gas flue of polygonal cross-section having at least five sides with an even number of sides being of equal length;

said tubes of each alternating side of said flue being bent inwardly of said flue into a first horizontal plane at one end of said flue while extending in groups in parallel relation to define a triangular opening between each pair of adjacent groups, said tubes of each tube group in said first horizontal plane extending to a common line, each said line extending between two points coincident with points where the outermost tube of one group meets an outermost tube of an adjacent group, said lines enclosing an area filled with extensions of at least some of said tubes in said first plane; and said tubes of the remaining sides of said flue being bent inwardly of said flue into a second horizontal plane at said end of said flue while extending in groups in parallel relation to cover each said triangular opening in said first horizontal plane.

2. A heat exchanger as set forth in claim 1 wherein said tubes in said sides and in said tube groups in said first plane are disposed on an equal pitch and said extensions are disposed on a less pitch.

3. A heat exchanger as set forth in claim 1 wherein said tubes in said sides and in said tube groups in said first plane are disposed on an equal pitch.

4. A heat exchanger as set forth in claim 2 wherein said tubes in said sides and in said tube groups in said second plane are disposed on an equal pitch.

5. A heat exchanger as set forth in claim 1 which further comprises a first header connected in common to said tubes of said first plane, and a plurality of headers respectively connected to a respective tube group of said second plane.

6. A heat exchanger as set forth in claim 5 wherein said plurality of headers is connected to said first header.

7. A heat exchanger as set forth in claim 5 wherein said axis is vertical and which further comprises a plurality of parallel members disposed between said tube groups and between said planes, said members being pivotally connected at each end to a side of said gas flue to transmit stresses from said tube groups to said sides.

8. A heat exchanger as set forth in claim 5 wherein at least said first header is a mixer for the medium flowing therethrough.

9. A heat exchanger comprising a plurality of medium-carrying wall tubes extending parallel to a longitudinal vertical axis to define a gas flue of polygonal cross-section having at least five sides with an even number of sides being of equal length;

said tubes of each alternating side of said flue being bent inwardly of said flue into a first horizontal plane at one end of said flue while extending in groups in parallel relation to define a triangular opening between each pair of adjacent groups;

said tubes of the remaining sides of said flue being bent inwardly to said flue into a second horiozntal plane at said end of said flue while extending in groups in parallel relation to cover each said triangular opening in said first horizontal plane;

a first header connected in common to said tubes of said first plane;

a plurality of headers respectively connected to a respective tube group of said second plane; and a plurality of parallel members disposed between said tube groups and between said planes, said members being pivotally connected at each end to a side of said gas flue to transmit stresses from said tube groups to said sides.

* * * * *

UNITED STATES PATENT AND TRADEMARK OFFICE

CERTIFICATE OF CORRECTION

PATENT NO. : 4,546,731

DATED : October 15, 1985

INVENTOR(S) : HEINZ AMMANN

It is certified that error appears in the above-identified patent and that said Letters Patent is hereby corrected as shown below:

Column 2, line 7 change "is feed to" to -is fed to-
Column 3, line 2 change "As indicated" to -As indicated in-
Column 3, line 8 change "As shown Fig. 2" to -As shown in Fig 2
Column 3, line 34 change "As indicated Figs." to -As indicated in Figs.-
Column 3, line 42 change "flue land" to -flue 1 and-
Column 3, line 58 change "provided webs" to -provided with webs
Column 5, line 19 change "accesible" to -accessible-
Column 5, line 42 change "readily to" to -to readily-
Column 5, line 61 change "polygomal" to -polygonal-
Column 6, line 55 change "horiozntal" -horizontal- Signed and Sealed this

*Twenty-fifth* Day of *March 1986*

[SEAL]

*Attest:*

DONALD J. QUIGG

*Attesting Officer* *Commissioner of Patents and Trademarks*